United States Patent [19]

Hamakawa et al.

[11] 4,018,856

[45] Apr. 19, 1977

[54] FUEL INCREASE SYSTEM FOR ENGINE

[75] Inventors: Genjiro Hamakawa, Tokorozawa; Kenji Naito, Kawasaki, both of Japan

[73] Assignee: Honda Giken Kogyo Kabushiki Kaisha, Tokyo, Japan

[22] Filed: Sept. 10, 1975

[21] Appl. No.: 612,228

[30] Foreign Application Priority Data

Sept. 13, 1974 Japan ..... 49-105828

[52] U.S. Cl. ..... 261/23 A; 261/34 B; 261/39 A; 261/DIG. 74; 123/32 ST; 123/180 T

[51] Int. Cl.[2] ..... F02M 7/08

[58] Field of Search ..... 261/34 B, 23 A, DIG. 74, 261/39 A; 123/127, 180 T, 32 ST

[56] References Cited

UNITED STATES PATENTS

| | | | |
|---|---|---|---|
| 2,022,027 | 11/1935 | Chandler | 261/34 B |
| 2,355,346 | 8/1944 | Weber | 261/34 B |
| 3,350,071 | 10/1967 | Scala, Jr. | 261/34 A |
| 3,706,444 | 12/1972 | Masaki et al. | 123/180 T |
| 3,837,322 | 9/1974 | Shishido et al. | 261/23 A |
| 3,842,810 | 10/1974 | Yagi et al. | 261/23 A |
| 3,852,379 | 12/1974 | Shishido et al. | 261/23 A |
| 3,882,831 | 5/1975 | Date et al. | 261/23 A |

*Primary Examiner*—Tim R. Miles
*Attorney, Agent, or Firm*—Lyon & Lyon

[57] ABSTRACT

An acceleration pump delivers additional fuel to both the main intake passage and the auxiliary intake passage of an internal combustion engine, to facilitate cold starting. In such an engine, each main combustion chamber is in communication with an auxiliary combustion chamber, respectively. Coordinated means are provided for operating said acceleration pump and throttle valves in said intake passages. Communication between the acceleration pump and the main intake passage remains open at all times, but a passageway connecting the acceleration pump and the auxiliary intake passage is closed except when the ambient temperature is low. Closure of the connecting passageway is effected automatically or in coordination with operation of the choke valve for the main intake passage.

6 Claims, 3 Drawing Figures

FUEL INCREASE SYSTEM FOR ENGINE

This invention relates to internal combustion engines and is particularly directed to apparatus for facilitating cold starting of engines of the type having an auxiliary combustion chamber in communication with each main combustion chamber, respectively. In such an engine, the auxiliary combustion chamber normally receives a rich mixture, and the main combustion chamber normally receives a lean mixture. Combustion is initiated by means of a spark plug associated with each auxiliary combustion chamber.

The present invention relates to a fuel increase system for carburetors used to supply both a lean mixture and a rich mixture to such engines. An acceleration pump is connected by passageways to deliver additional fuel to the main intake passage and to the auxiliary intake passage, and the acceleration pump is connected for coordinated operation with throttle valves in each of said intake passages. The passageway connecting the acceleration pump to the main intake passage remains open at all times, but the passageway connecting the acceleration pump to the auxiliary intake passage is opened only when the ambient temperature is low. The additional fuel supplied by the acceleration pump to the auxiliary intake passage greatly improves startability under very cold conditions, but after the engine is warmed up, this latter passageway is closed in order to reduce the amount of unburned hydrocarbons in the exhaust gases discharged into the atmosphere.

Other and more detailed objects and advantages will appear hereinafter.

Figure 1:
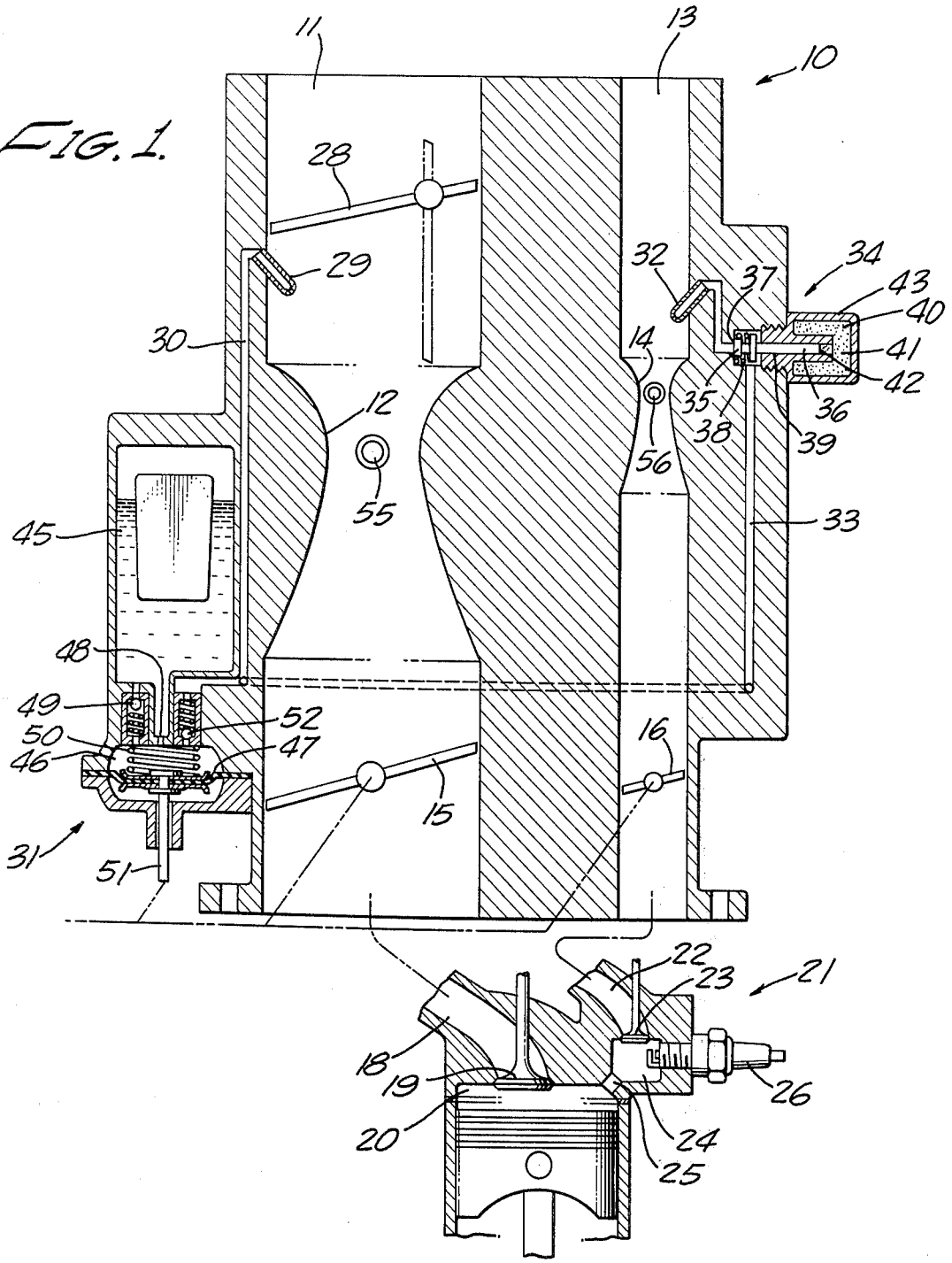
FIG. 1 is a sectional side elevation showing a preferred embodiment of this invention.

Referring to the drawings, and particularly to FIG. 1, a carburetor assembly generally designated 10 includes a first carburetor having a main intake passage 11 including a venturi throat 12, as well as an auxiliary intake passage 13 having a venturi throat 14. A main throttle valve 15 is mounted to turn in the main intake passage 11, and an auxiliary throttle valve 16 is mounted to turn in the auxiliary intake passage 13.

The main intake passage 11 is connected through head passage 18 and main intake valve 19 to the main combustion chamber 20 of the engine generally designated 21. Similarly, the auxiliary intake passage 13 is connected through head passage 22 and auxiliary intake valve 23 to the auxiliary combustion chamber 24. The torch opening 25 establishes communication between the auxiliary combustion chamber 24 and the main combustion chamber 20. A spark plug 26 ignites a rich mixture in the auxiliary combustion chamber 24 to project a flame through the torch opening 25 to ignite the lean mixture in the main combustion chamber 20.

A choke valve 28 of conventional type is mounted in the main intake passage 11. An acceleration nozzle 29 extends into the main intake passage 11 below the choke valve 28 when it is in closed position, and this acceleration nozzle 29 is connected by passageway 30 to the acceleration pump generally designated 31. An acceleration nozzle 32 projects into the auxiliary intake passage 13 and is connected to the acceleration pump 31 by way of the passageway 33. A control valve assembly 34 is interposed in this passageway 33.

The control valve assembly 34 includes a valve head 35 fixed to a valve stem 36 and adapted to close against a stationary seat 37. A coil compression spring 38 acts on the valve stem 36 to move the valve head 35 in a direction away from the stationary seat 37. The valve stem 36 slides in a bore 39 communicating with a chamber 40 containing heat responsive material such as wax 41. The wax 41 acts on the end surface 42 of the stem 36. A suitable case 43 forms the chamber 40 for the wax material 41.

The acceleration pump 31 is conventional in form and may be mounted below the float chamber 45. The expansible chamber 46 above the flexible diaphragm 47 is connected to the float chamber 45 through the restricted orifice 48 and through the check valve 49. The check valve 49 permits flow of the liquid fuel from the float chamber 45 into the expansible chamber 46, but prevents flow in the reverse direction. Another check valve 52 permits flow of fuel from the expansible chamber 46 to both of the passageways 30 and 33, but prevents flow in the reverse direction. A spring 50 acts on the flexible diaphragm 47 in a direction to increase the size of the expansible chamber 46 and to move the flexible diaphragm 47 and its operating rod 51 downward, as shown in FIG. 1.

The main throttle valve 15 in the main intake passage 11 and the auxiliary throttle valve 16 in the auxiliary intake passage 13 are mechanically interconnected, as shown by the dashed lines, with the operating rod 51 of the acceleration pump 31.

When the engine ambient temperature is in a range of low tempertures where starting of the engine is difficult, the spring 38 of the control valve assembly 34 moves the valve stem 36 in a direction to separate the valve head 35 from the stationary seat 37, thereby establishing communication between the acceleration pump 31 and the acceleration nozzle 32 through the passageway 33. The coordinated means for actuating both throttle valves 15 and 16 are moved an appropriate number of times to operate the acceleration pump 31 and thereby discharge an appropriate amount of additional fuel through the passageways 30 and 33 to the nozzles 29 and 32. The choke valve 28 is then closed as necessary, and the engine 21 is cranked. During cranking fuel is delivered to the main intake passage 11 and the auxiliary intake passage 13 through high speed nozzles 55 and 56, as well as through low speed nozzles (not shown), all of the fuel mixes with air to produce mixtures whose air-fuel ratio is richer than normal in each intake passage, so that the engine 21 may be readily started.

After starting of the engine, if both throttle valves 15 and 16 are suddenly opened to accelerate the speed of the engine when it is not yet warm, the acceleration pump 31 again injects fuel through both acceleration nozzles 29 and 32 so that richer than normal mixtures are supplied to the main combustion chamber 20 and to the auxiliary combustion chamber 24 without delay, increasing the output of the engine immediately. After the engine is warmed up, the heat responsive material 41 expands by heat from the engine, and the resulting force on the end surface 42 of the stem 36 closes the valve head 35 against the stationary seat 37 against the action of the spring 38. Subsequent acceleration operations cause the acceleration nozzle 29 to inject fuel, but the auxiliary acceleration nozzle 32 remains inoperative.

The auxiliary combustion chamber 24 is relatively small in volume and heats rapidly to evaporate fuel so that when the air-fuel mixture is ignited electrically it produces a good flame, without misfire, to burn the lean mixture in the main combustion chamber 20. On the other hand, the mixture produced in the main intake passage 11 is normally so lean as to lie close to the inflammability limit, so that it tends to become excessively lean during engine acceleration operation. This tendency toward excessive leanness is properly corrected by the fuel injected through the acceleration nozzle 29, thus ensuring optimum ignition thereof in the main combustion chamber 20 by flame from the auxiliary combustion chamber 24. The engine output increases immediately.

Figure 2:
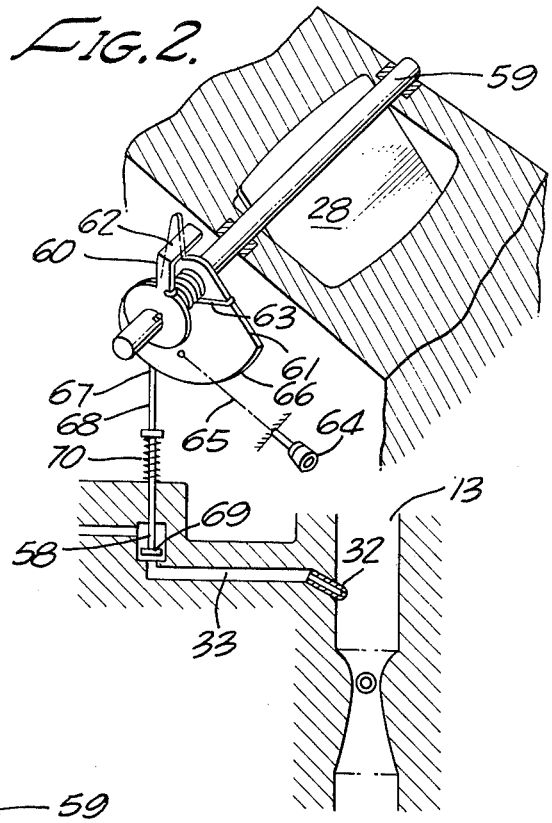
FIG. 2 is a schematic view, partly in section, showing a modification.

In the modified form of the invention shown in FIG. 2, the control valve assembly 58 in the passageway 33 leading to the auxiliary acceleration nozzle 32 is connected for coordinated operation with the choke valve 28 in the main intake passage 11. An arm 60 is fixed to the choke valve shaft 59, and a choke lever 61 is mounted to turn freely on the choke valve shaft 59. The arm 60 has an angular extension 62 for engagement with the choke lever 61, and a spring 63 connects the choke lever 61 and the arm 60 to cause the extension 62 to contact a side edge of the choke lever 61. When the choke operating knob 64 is pulled, the cable 65 causes the choke lever 61 and arm 60 to rotate together to close the choke valve 28. When the choke valve reaches the fully closed position, the choke lever 61 may continue its turning motion to increase the torsional force of the spring 63. In this way the closing torque of the choke valve 28 is increased. The effect is to cause the main intake passage 11 to produce a richer than normal mixture at the time of starting the engine under low temperature or extremely cold conditions.

The choke lever 61 is provided with a cam face 66 which engages the outer end 67 of the stem 68 of the control valve 69. The spring 70 acts in a direction to open control valve 69. A portion of the cam face 66 is concentric with the axis of the choke valve shaft 59, so that the control valve 69 is maintained in closed position when the arm 60 and the choke lever 61 rotate in unison. The remainder of the cam face 66 has a changing radius of curvature so as to permit the control valve 69 to open under force of spring 70 when the choke lever 61 continues movement after closing of the choke valve 28.

In this embodiment of the invention, cold starting of the engine is accomplished by manually pulling the choke operating knob 64 enough to give the choke lever 61 excess turning movement, and the control valve 69 is opened by force of the spring 70. Thereafter, rapid repeated opening and closing of the throttle valves causes the acceleration pump to inject fuel through the control valve 69 and through the auxiliary nozzle 32 in the auxiliary intake passage 13. After the engine begins to run on its own power, the choke operating knob 64 is pushed to open the choke valve 28, and this causes the cam face 66 to close control valve 69.

Figure 3:
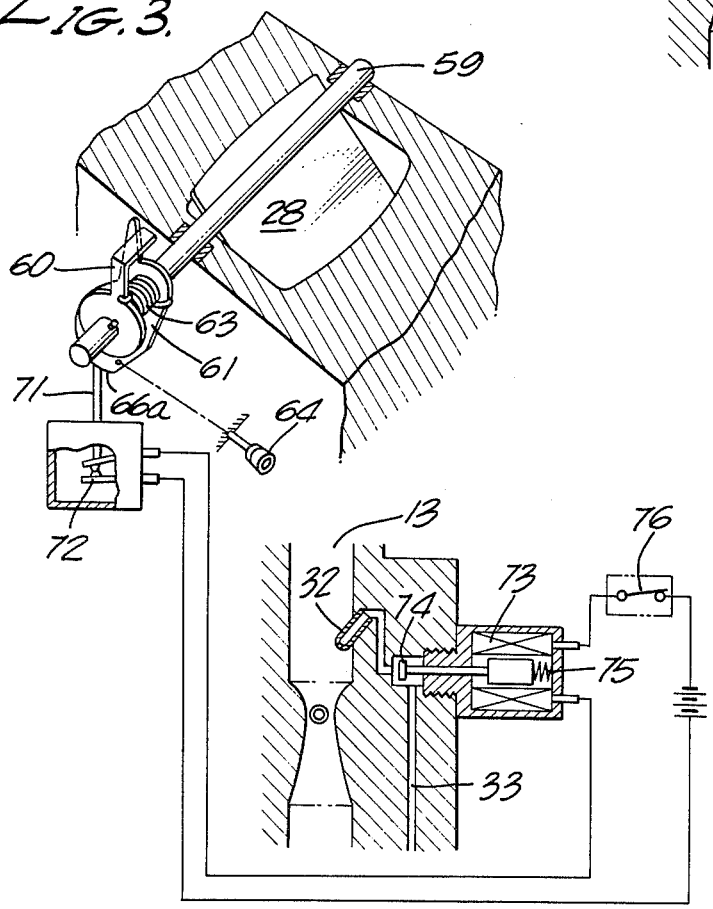
FIG. 3 is a schematic view, partly in section, showing another modification.

The second modified form of the invention shown in FIG. 3 also has the feature of closing the control valve by means of mechanism coordinated with actuation of the choke valve 28 in the main intake passage 11. The interlocking mechanism between the choke operating knob 64 and the choke valve shaft 59 is similar to that shown in FIG. 2, except that the cam face 66*a*has a gradually increasing radius of curvature from end to end. A sensor rod 71 is engaged by the cam face 66*a* and operates a limit switch 72 of the normally-open type. A solenoid actuator 73 when energized acts to hold the control valve 74 in open position against the action of the spring 75. The main switch 76 is interlocked with operation of the ignition switch (not shown) of the engine.

When the main switch 76 is closed and the choke operating knob 64 is pulled to close the choke valve 28 and the cause additional turning movement of the choke lever 61, the sensor rod 71 is depressed by the cam face 66*a* to close the limit switch 72. This closes an electrical circuit through the solenoid actuator 73 to open the control valve 74. The acceleration pump 31 may then be employed as described above to increase the amount of fuel supplied to the auxiliary combustion chamber 24. When the choke operating knob 64 is pushed back to open the choke valve 28, the limit switch 72 is opened to de-energize the solenoid actuator 73 and permit the spring 75 to close the control valve 74.

In the three forms of the invention described above, the auxiliary nozzle 32 is provided in the auxiliary intake passage 13 and connected to the acceleration pump 31 that is ordinarily provided for delivering fuel to the acceleration nozzle 29 in the main intake passage 11. An auxiliary nozzle 32 in the auxiliary intake passage 12 receives fuel from the acceleration pump 31 only when a control valve is open to improve engine startability under cold or very cold conditions. Furthermore, the fact that no additional or special pump is required simplifies the construction and reduces the cost.

Having fully described our invention, it is to be understood that we are not to be limited to the details herein set forth but that our invention is of the full scope of the appended claims.

We claim:

1. For use with an internal combustion engine having an auxiliary combustion chamber in communication with each main combustion chamber, respectively, and having a main carburetor intake passage for supplying a lean mixture to each main combustion chamber and an auxiliary carburetor intake passage for supplying a rich mixture to each auxiliary combustion chamber, the improvement comprising, in combination: an acceleration pump, acceleration nozzles, one opening into each carburetor intake passage, respectively, passageways connecting the pump to each nozzle, a control valve in the passageway connecting the pump to the nozzle in the auxiliary carburetor intake passage, the other passageway being open and unrestricted, and means for opening said control valve when the ambient temperature is low and for closing said control valve when the ambient temperature is high.

2. The combination set forth in claim 1 in which said means comprises a heat-responsive device for automatically opening the control valve upon decrease in the ambient temperature below a predetermined level.

3. The combination set forth in claim 1 in which a choke valve is positioned in the main carburetor intake passage, and in which coordinated means are provided for closing the choke valve and opening said control valve.

4. The combination set forth in claim 3 in which resilient means are provided for opening the control valve and wherein cam means movable with the choke valve are provided for closing the control valve in opposition to said resilient means.

5. The combination set forth in claim 2 in which said control valve is actuated by an electric solenoid.

6. The combination set forth in claim 4 in which sid coordinated means include an electric solenoid for actuating the control valve and an electric switch in circuit with said electric solenoid operated in accordance with the position of the choke valve.

* * * * *